US008948922B2

(12) United States Patent
Schleuthner

(10) Patent No.: US 8,948,922 B2
(45) Date of Patent: Feb. 3, 2015

(54) METHOD FOR IDENTIFYING OPERATING CONDITIONS OF A DOMESTIC APPLIANCE

(75) Inventor: Andreas Schleuthner, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 150 days.

(21) Appl. No.: 13/129,153

(22) PCT Filed: Nov. 6, 2009

(86) PCT No.: PCT/EP2009/064779

§ 371 (c)(1),
(2), (4) Date: May 17, 2011

(87) PCT Pub. No.: WO2010/054996

PCT Pub. Date: May 20, 2010

(65) Prior Publication Data

US 2011/0224834 A1 Sep. 15, 2011

(30) Foreign Application Priority Data

Nov. 14, 2008 (DE) ..... 10 2008 043 760

(51) Int. Cl.

*G05D 23/19* (2006.01)
*D06F 33/02* (2006.01)
*D06F 39/08* (2006.01)

(52) U.S. Cl.

CPC ..... *D06F 33/02* (2013.01); *D06F 39/081* (2013.01); *D06F 2202/04* (2013.01); *D06F 2204/086* (2013.01); *D06F 2212/00* (2013.01)
USPC ..... 700/299; 68/12.02; 8/137; 34/527

(58) Field of Classification Search

CPC ... D06F 33/02; D06F 39/081; D06F 2212/00; D06F 2204/086; D06F 2202/04
USPC ..... 700/278, 300, 275, 299; 8/137, 158, 8/159; 68/12.02, 12.03; 137/79, 80; 34/527, 596
See application file for complete search history.

(56) References Cited

U.S. PATENT DOCUMENTS

| | | | | |
|---|---|---|---|---|
| 4,213,250 | A | 7/1980 | Hawkins | |
| 5,146,693 | A * | 9/1992 | Dottor et al. | 34/77 |
| 5,220,813 | A * | 6/1993 | Chen et al. | 68/3 SS |
| 5,394,704 | A * | 3/1995 | Johnson | 62/51.1 |
| 5,507,251 | A * | 4/1996 | Hollis | 123/41.1 |
| 5,659,454 | A * | 8/1997 | Vermesse | 361/104 |
| 6,255,952 | B1 * | 7/2001 | Jang | 340/588 |
| 6,397,607 | B1 * | 6/2002 | Camp et al. | 62/155 |
| 6,523,370 | B1 | 2/2003 | Broker et al. | |
| 6,634,048 | B1 * | 10/2003 | Hornung et al. | 8/158 |
| 6,671,978 | B1 * | 1/2004 | McGowan et al. | 34/596 |
| 6,700,102 | B2 * | 3/2004 | St. Louis | 219/511 |
| 6,954,995 | B2 * | 10/2005 | Kitamura et al. | 34/597 |
| 6,987,457 | B2 * | 1/2006 | Yin et al. | 340/584 |
| 7,017,280 | B2 * | 3/2006 | Green et al. | 34/486 |
| 7,055,262 | B2 * | 6/2006 | Goldberg et al. | 34/86 |
| 7,191,546 | B2 * | 3/2007 | Maruca | 34/201 |
| 7,302,815 | B2 * | 12/2007 | Kim et al. | 68/18 C |
| 7,377,052 | B2 * | 5/2008 | Maruca | 34/201 |
| 7,434,745 | B2 * | 10/2008 | Deiss et al. | 236/92 B |
| 7,477,950 | B2 * | 1/2009 | DeBourke et al. | 700/19 |
| 7,665,225 | B2 * | 2/2010 | Goldberg et al. | 34/73 |
| 7,932,480 | B2 * | 4/2011 | Gu et al. | 219/482 |
| 7,954,506 | B2 * | 6/2011 | Swan | 137/80 |
| 8,008,603 | B2 * | 8/2011 | MacKenzie | 219/490 |
| 8,130,107 | B2 * | 3/2012 | Meyer | 340/605 |
| 8,601,627 | B2 * | 12/2013 | Kim et al. | 8/159 |
| 2003/0097764 | A1 * | 5/2003 | St. Louis | 34/524 |
| 2004/0206394 | A1 * | 10/2004 | Swan | 137/79 |
| 2005/0066538 | A1 * | 3/2005 | Goldberg et al. | 34/218 |
| 2005/0278972 | A1 * | 12/2005 | Maruca | 34/201 |
| 2006/0168611 | A1 * | 7/2006 | Fima | 725/10 |
| 2006/0174707 | A1 * | 8/2006 | Zhang | 73/592 |
| 2006/0179676 | A1 * | 8/2006 | Goldberg et al. | 34/77 |
| 2006/0179895 | A1 * | 8/2006 | Thorn et al. | 68/12.16 |
| 2006/0272704 | A1 * | 12/2006 | Fima | 137/12 |
| 2007/0113421 | A1 * | 5/2007 | Uhara et al. | 34/275 |
| 2007/0144032 | A1 * | 6/2007 | Maruca | 34/469 |
| 2007/0193056 | A1 * | 8/2007 | Switalski | 34/88 |
| 2007/0235440 | A1 * | 10/2007 | Gu et al. | 219/482 |
| 2008/0115539 | A1 * | 5/2008 | Nishino et al. | 68/12.03 |
| 2008/0141550 | A1 * | 6/2008 | Bae et al. | 34/68 |
| 2009/0025407 | A1 * | 1/2009 | Dalla Valle et al. | 62/129 |
| 2009/0139110 | A1 * | 6/2009 | Oh et al. | 34/553 |

(Continued)

FOREIGN PATENT DOCUMENTS

| | | | |
|---|---|---|---|
| DE | 3703918 A | * | 8/1988 |
| DE | 3703918 A1 | | 8/1988 |

(Continued)

OTHER PUBLICATIONS

International Search Report PCT/EP2009/064779.

*Primary Examiner* — Charles Kasenge

(74) *Attorney, Agent, or Firm* — Nixon & Vanderhye P.C.

(57) ABSTRACT

In a method for identifying operating conditions of a domestic appliance, a temperature of an operating agent of the domestic appliance and/or of a component of the domestic appliance is detected by a temperature sensor. The ambient temperature is detected by the temperature sensor before the programming mode, in an initialization phase. At least one reference temperature value is defined that represents a critical value for the programming mode of the domestic appliance in respect of reliable and/or efficient operation. The programming mode is prevented from beginning as a function of the comparison of the measured ambient temperature with at least one reference temperature value. The programming mode is prevented from beginning until the ambient temperature has reached a value that is in an acceptable range in comparison with the reference temperature value.

14 Claims, No Drawings

(56) References Cited

U.S. PATENT DOCUMENTS

| | | | | |
|---|---|---|---|---|
| 2009/0229279 | A1* | 9/2009 | Dalla Valle et al. | 62/93 |
| 2009/0235992 | A1* | 9/2009 | Armstrong | 137/487.5 |
| 2009/0300850 | A1* | 12/2009 | Yoo | 8/149.3 |
| 2009/0306536 | A1* | 12/2009 | Ranganathan et al. | 600/549 |
| 2010/0045471 | A1* | 2/2010 | Meyers | 340/605 |
| 2010/0132130 | A1* | 6/2010 | Moon et al. | 8/137 |

FOREIGN PATENT DOCUMENTS

| | | | | |
|---|---|---|---|---|
| JP | 4105696 | A | | 4/1992 |
| JP | 4129597 | A | | 4/1992 |
| JP | 04129597 | A | * | 4/1992 |
| JP | 04285599 | A | * | 10/1992 |
| JP | 2001062195 | A | * | 3/2001 |
| JP | 2004222760 | A | | 8/2004 |
| KR | 2008075693 | A | * | 8/2008 |

* cited by examiner

METHOD FOR IDENTIFYING OPERATING CONDITIONS OF A DOMESTIC APPLIANCE

This application is a U.S. National Phase of International Application No. PCT/EP2009/64779, filed Nov. 6, 2009, which designates the U.S. and claims priority to German Application No. 102008043760.3, filed Nov. 14, 2008, the entire contents of each are hereby incorporated by reference.

BACKGROUND OF THE INVENTION

The invention relates to a method for identifying operating conditions of a domestic appliance, in which method a temperature of an operating means of the domestic appliance and/or of a component of the domestic appliance are/is detected by means of a temperature sensor in a programming mode of the domestic appliance.

In the course of rapidly advancing globalization and the demands associated therewith that are made of domestic appliances on a wide variety of markets with their specific requirements it is necessary to adapt the development of parts and components to the respective conditions to satisfy needs and users. However, the operating conditions are sometimes significantly impaired by physical phenomena, such as ambient temperatures of the domestic appliances. Therefore, in water-conveying domestic appliances components can freeze, by way of example, at relatively cold temperatures below freezing point. On the other hand, the functional limit of a domestic appliance may be reached in operating conditions which have very high temperatures.

A user conventionally operates his domestic appliance in such conditions despite corresponding information in the instructions because he mainly does not have any way of checking these requirements on site. Frost damage can therefore occur to water systems, such as the drain pump of a washing machine, or excessively long drying times in the case of tumble dryers due to the reduced cooling effect.

Document U.S. Pat. No. 6,255,952 B1 describes a washing machine in which the ambient temperature is measured by means of a temperature sensor before the actual washing process is started. The temperature sensor can also measure the temperature of the water that is being supplied to a washing machine outer tub. A limit value is set in the washing machine for the ambient temperature. A check is performed as to whether the ambient temperature falls below the set limit value. If this is not the case additional method steps are carried out and the actual washing process is optionally started. If the ambient temperature falls below the set limit value, operation of the washing machine is terminated.

Document U.S. Pat. No. 4,213,250 A describes a tumble dryer. Using a knob an operator can set the duration of a drying process. Marking means are provided which mark a certain position for the knob as a function of the ambient temperature. The operator can therefore set a drying process duration which is optimal in the case of the ambient temperature given in each case. This procedure builds on the fact that the duration required for drying items of laundry is proportional to the ambient temperature.

BRIEF SUMMARY OF THE INVENTION

The object of the present invention is to create a method for identifying operating conditions of a domestic appliance in which adverse factors influencing the operating condition of the domestic appliance are easily recognized.

This object is achieved by a method which has the features as claimed in the independent claim. Preferred developments of the method are the subject matters of corresponding dependent claims and the following statements.

In an inventive method for identifying operating conditions of a domestic appliance a temperature of an operating means of the domestic appliance and/or of a component of the domestic appliance are/is detected by means of a temperature sensor in a programming mode of the domestic appliance. An ambient temperature of the domestic appliance is detected by means of the temperature sensor before the programming mode in an initialization phase. A specific parameter, namely the ambient temperature, which significantly affects the operating conditions and the operating behavior of the domestic appliance, is therefore detected with the inventive method using a temperature sensor that is present anyway.

At least one reference temperature is set which represents a critical value for the programming mode of the domestic appliance in respect of reliable and/or efficient operation. It can therefore be ensured at any time that undesirable effects on the operating behavior of the domestic appliance during the programming mode are recognized early and precisely those conditions that are jeopardizing operation can consequently be recognized in good time before the actual programming mode and appropriate information is given or action taken. Therefore, when the ambient temperatures are too low, by way of example, and a risk of frost could possibly occur for components or operating means of the domestic appliance during programming mode, corresponding information can be given or an appropriate measure can take place or be taken. If efficient operation cannot be guaranteed, for example owing to an excessive energy requirement or a disproportionately long extension to a programming mode owing to the ambient conditions, then this can also be shown or a measure taken.

The programming mode is prevented from beginning as a function of the comparison of the measured ambient temperature with at least one reference temperature value. If during the comparison it is found that the ambient temperature differs undesirably upwards or downwards from the reference temperature value and that an undesirable operating condition impairment of the domestic appliance will, or can at least, occur due to this difference, the actual programming mode is preferably prevented in the initialization phase and before the programming mode.

The programming mode is prevented from beginning until the ambient temperature has reached a value which is in an acceptable range in comparison with the at least one reference temperature value. An acceptable range is taken to mean the value interval which is rated uncritical in respect of the operating condition of the domestic appliance being affected. A maximal period is preferably defined for this hindering of the beginning of the programming mode. This prevents an undesirably long period of beginning of programming mode being prevented without there being any prospect of changing the ambient temperature in a direction which would enable the programming mode to start. Unnecessarily high energy consumption of the domestic appliance can be prevented as a result.

The initialization phase is the period following the start of the domestic appliance in which loading operations of computer programs for controlling the domestic appliances and the like are loaded and started and corresponding additional steps and procedures are carried out to be able to subsequently implement a proper programming mode. The initialization phase therefore describes a period in which there is still no proper programming mode sequence.

However, it is precisely this relatively short time phase that is used to be able to detect the ambient temperature and to then be able to determine whether any favorable or adverse effects could occur on the operating behavior of the domestic appliance in the subsequent programming mode.

Operating means of a domestic appliance are taken to mean both liquid and gaseous media which are necessary for a programming mode to be able to be carried out properly and which are required for carrying out the programming mode. In the case of a tumble dryer these can be, for example, the process air and the cooling air. In the case of a fully automatic washing machine or a washing machine this can be the washing liquor for example. The operating means mentioned by way of example should not be taken to be comprehensive. Instead they are merely intended to indicate the character that should be incorporated by the designation of an operating means.

The measured ambient temperature is preferably compared with a reference temperature value and this is communicated to a user as a function of the comparison. A user can therefore be informed about adverse effects of the ambient temperature on the operating condition of the domestic appliance at any time and act accordingly.

A warning to the user is preferably therefore generated as a function of the comparison of the measured ambient temperature with at least one reference temperature value. The warning is preferably shown as information on a display unit. It may also be provided that acoustic information is reproduced as well as or instead of this.

In particular the user of the domestic appliance should therefore receive information about the appliance controller or the operating module if the ambient temperature of the site is outside an admissible range. Damage to parts and therewith failure of components can therefore be avoided as a result. Functional impairments and malfunctions as well as warranty claims which can be attributed to extreme climates can consequently likewise be avoided or at least considerably reduced.

A threshold is preferably given by a first reference temperature value, and when this is not attained by the ambient temperature it is possible for water-conveying components of the domestic appliance to freeze.

A threshold is preferably given by a second reference temperature value, and when this is not attained by the ambient temperature the duration of a programming mode will be extended. A temperature value of 5° C. is preferably specified by the first reference temperature value.

The second reference temperature value preferably lies above 30° C., and preferably above 35° C. It is precisely at such temperatures that increased energy consumption of the domestic appliances, and in particular of dryers, occurs because an efficient programming mode and therefore efficient drying is not provided. Excessively long drying times occur due to the reduced cooling effect in the case of such hot ambient conditions.

The domestic appliance is preferably designed for caring for items of laundry. A washing machine or a tumble dryer or a washer dryer in particular can be provided in this regard.

DETAILED DESCRIPTION OF A PREFERRED EMBODIMENT

An exemplary embodiment of the invention will be described below. A domestic appliance which is designed for caring for items of laundry comprises at least one temperature sensor. In its original functionality the temperature sensor is designed to detect or measure a temperature of an operating means of the domestic appliance and/or a component of the domestic appliance during a programming mode. It may therefore be provided in a fully automatic washing machine, by way of example, that the washing liquor temperature is measured using this temperature sensor and the domestic appliance is monitored and controlled as a function thereof. With tumble dryers the temperature of the process and cooling air can be detected using such a temperature sensor and the appliance can then be monitored and controlled as a function thereof. When the appliances are initially used the temperature sensors are still measuring the room temperature. The temperature sensors are also provided with an additional functionality, namely that in an initialization phase, which comes before the programming mode, they detect an ambient temperature of the domestic appliance. This/these temperature sensor(s) are therefore scanned by the user during the initialization phase when the domestic appliance is switched on and provide information about the ambient temperature in this initialization phase.

The signal of the temperature sensor is then evaluated in a control unit or evaluation unit of the domestic appliance and compared with at least one reference temperature value. In an exemplary embodiment it is provided that a lower first reference temperature value is specified which is, for example, 5° C. An upper, second reference temperature value which is, for example, 35° C. is also specified. If the ambient temperature is accordingly in the acceptable range between 5° C. and 35° C. it may be assumed that the programming mode can run properly or can run in an acceptable tolerance interval. This in respect of the possibility of undesirably high energy consumption due to excessive extension of the programming mode owing to the energy ambient temperature, or in respect of the fact that freezing of components owing to lower ambient temperatures will most probably not occur or can be completely ruled out.

However, if it is found that the ambient temperature is less than the first, lower reference temperature value and is therefore lower than 5° C., a warning is communicated to the user which is in particular displayed on a display unit of the domestic appliance. Text and/or symbols and/or numbers can be displayed in this connection. It may therefore be displayed, by way of example, that the ambient temperature is too low and the risk of frost damage can occur during programming mode. It may also be provided that a 'single' word, such as 'risk of frost' is displayed. If the domestic appliance is constructed as a dryer a display can, by way of example, state that it is also being communicated that the ambient temperature is too high, for example, when it is greater than the second reference temperature value and is therefore greater than 35° C. It may also be indicated that due to the high ambient temperatures significantly extended drying times may be expected, and increased energy consumption occurs as a result.

It is preferably provided that in a case where the ambient temperature is outside of the acceptable range, the start of the programming mode is automatically stopped. This can also be communicated to a user. Furthermore, it may also be provided that the stoppage continues until an ambient temperature is in an appropriate acceptable range. Once this is attained the programming mode can be automatically started. If such a scenario is implemented the temperature is also detected several times after the initialization phase because the end of the ambient temperature can obviously last longer than the initialization phase, so even after the initialization phase has passed this temperature is measured and a decision is then made as to whether a programming mode is started.

In the case of domestic appliances for caring for items of laundry, frost damage and other undesirable operating conditions can be avoided as a result of this method and therefore the evaluation of the ambient temperature at least occasionally in a specific time phase, namely the initialization phase. The failure probability of such appliances can be reduced therewith and the customer service requests can also be reduced therefore. Information can therefore be obtained which allows effective and reliable operation of the domestic appliance in particular also for tumble dryers and shirt ironing machines, without additional components in the domestic appliance and ultimately using a temperature sensor that is present anyway.

What is claimed is:

1. A method for identifying operating conditions of a domestic appliance, said method comprising the steps of:

detecting a value of an ambient temperature during an initialization phase before a programming mode of an appliance begins using a sensor that, in the programming mode of the appliance, detects the temperature of an operating agent of the appliance, or a component of the appliance, or both, wherein the appliance is a kitchen appliance, a laundry appliance, and/or a cleaning appliance and the initialization phase is a period of time in which a computer program used during the programming mode is loaded;

comparing the ambient temperature to at least one reference temperature, said reference temperature representing a critical value for the programming mode of the domestic appliance; and preventing the programming mode from starting until the value of the ambient temperature has attained a value that is within a predetermined range of the reference temperature value, the predetermined range being finite.

2. The method of claim 1, further comprising the step of communicating to a user whether or not the value of the ambient temperature is within the predetermined range.

3. The method of claim 1, further comprising the step of warning a user if the value of the ambient temperature is not within the predetermined range.

4. The method of claim 3 wherein the warning is provided on a display unit.

5. The method of claim 3 wherein the warning is provided as acoustic information.

6. The method of claim 1 wherein the reference temperature value is a threshold value below which it is possible for water-conveying components of the domestic appliance to freeze.

7. The method of claim 1 wherein the reference temperature value is a threshold value above which the duration of the programming mode would be extended.

8. The method of claim 7 wherein the detecting step detects a value of an ambient temperature of a laundry dryer, and the duration of the programming mode of the laundry dryer would be extended due to the value of the ambient temperature being above the reference value.

9. The method of claim 1 wherein the domestic appliance is designed for caring for items of laundry.

10. The method of claim 1, further comprising the step of automatically starting the programming mode when the value of the ambient temperature attains a value that is in the predetermined range, the step of automatically starting taking place after the preventing step has been taken.

11. The method of claim 1 wherein the operating agent is a fluid media.

12. A method for identifying operating conditions of a domestic appliance, said method comprising the steps of:

detecting a value of an ambient temperature during an initialization phase before a programming mode of an appliance begins using a sensor that, in the programming mode of the appliance, detects the temperature of an operating agent of the appliance, or a component of the appliance, or both, wherein the appliance is adapted to operate with a fluid media to carry out the programming mode and the initialization phase is a period of time in which a computer program used during the programming mode is loaded;

comparing the ambient temperature to at least one reference temperature, said reference temperature representing a critical value for the programming mode of the domestic appliance;

preventing the programming mode from starting until the value of the ambient temperature has attained a value that is within a predetermined range of the reference temperature value, the predetermined range being finite; and repeating the detecting and comparing steps after the programming mode has been prevented from beginning because the value of the ambient temperature had not attained a value that is in the predetermined range.

13. The method of claim 12 further comprising automatically starting the programming mode when the value of the ambient temperature attains a value that is in the predetermined range.

14. The method of claim 12 wherein the operating agent is a fluid media.

* * * * *